US007397896B2

(12) United States Patent
Beyerlein

(10) Patent No.: US 7,397,896 B2
(45) Date of Patent: Jul. 8, 2008

(54) X-RAY DEVICE

(75) Inventor: Walter Beyerlein, Bubenreuth (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/724,648

(22) Filed: Mar. 15, 2007

(65) Prior Publication Data

US 2007/0217574 A1 Sep. 20, 2007

Related U.S. Application Data

(60) Provisional application No. 60/782,720, filed on Mar. 15, 2006.

(30) Foreign Application Priority Data

Mar. 15, 2006 (DE) ..... 10 2006 011 968

(51) Int. Cl.
*H05G 1/14* (2006.01)
*H05G 1/10* (2006.01)
*H05G 1/32* (2006.01)

(52) U.S. Cl. ..... 378/107; 378/101; 378/111

(58) Field of Classification Search ..... 378/15, 378/91, 101, 107, 104, 193–197, 111
See application file for complete search history.

(56) References Cited

U.S. PATENT DOCUMENTS 2,717,315 A * 9/1955 Nemet et al. ..... 378/103
4,969,171 A 11/1990 Yamada et al.
5,646,835 A * 7/1997 Katcha ..... 363/98
6,674,836 B2 * 1/2004 Harada et al. ..... 378/107
6,975,698 B2 * 12/2005 Katcha et al. ..... 378/15

* cited by examiner

*Primary Examiner*—Irakli Kiknadze

(57) ABSTRACT

An X-ray device having an X-ray source, a high voltage generator supplying power to the X-ray tube and an inverter to generate, at the output end, an AC input voltage for the high voltage generator is disclosed. Provision is made therein for a resonance network to be formed between the inverter and the high voltage generator. This allows transmission of the AC input voltage with low power dissipation and low radiation levels. It also achieves spatial separation of the inverter from the high voltage generator and the X-ray source.

17 Claims, 2 Drawing Sheets

X-RAY DEVICE

CROSS REFERENCE TO RELATED APPLICATIONS

The present application claims the benefit of the provisional patent application filed on Mar. 15, 2006, and assigned application No. 60/782,720. The present application also claims priority of German application No. 10 2006 011 968.1 filed on Mar. 15, 2006. Both of the applications are incorporated by reference herein in their entirety.

FIELD OF THE INVENTION

The invention relates to an X-ray device having an X-ray source, a high voltage generator supplying power to the X-ray tube and an inverter at the output end to generate an AC input voltage for the high voltage generator.

BACKGROUND OF THE INVENTION

In such an X-ray device, the inverter usually generates a DC voltage from a network AC voltage in an intermediate circuit, said DC voltage being inverted by means of an inverse rectifier into a higher frequency AC input voltage for the high voltage generator. By means of a transformer and a rectifier, for example, the high voltage generator then generates the high voltage required by the X-ray tube in the order of magnitude of about 100 kV. The X-ray tube in the X-ray device is used, for example, to generate radiation for medical applications, in particular in a computer tomography scanner.

In a medical X-ray device in particular, spatial separation of the inverter from the high voltage generator or from the X-ray source is desirable since cumbersome equipment in the vicinity of the X-ray source would restrict the access required when taking an angiogram, for example. This particularly applies to a computer tomography scanner where the X-ray source rotates around the patient and consequently the energy has to be supplied by a fixed system.

If the high voltage generated by the high voltage generator is supplied to the X-ray source in known proportions over circuits of a corresponding length, this results in high capacitors in the high voltage circuit which cause interference when using pulses, because large amounts of energy are stored. Disadvantageously, this leads to an exposure of the patient to radiation that is unnecessary because no image is generated. Furthermore, in the event of collision ionization in an X-ray tube, the stored energy leads to considerable interference with the electronic systems located in the vicinity. If the high voltage is supplied to the rotating gantry of a computer tomography scanner via slip rings, then the volume of air required for the isolation of the high voltage is very considerable, which involves a considerable disadvantage in terms of costs.

Alternatively, it is known for the network AC voltage or for a DC voltage generated for this purpose for the intermediate circuit to be supplied to the rotating system by means of slip rings. However, this presents the problem already mentioned in the introduction that the further components required to generate the high voltage also have to be mounted on the rotating system, which results in considerable outlay in order to achieve mechanical stability because of the bulk and volumes involved, particular at high rotation speeds.

U.S. Pat. No. 4,969,171 discloses an X-ray device of the kind mentioned in the introduction, in which device, at the output end, the AC input voltage of the inverter is transmitted from the stationary end via slip rings to a rotating high voltage generator. In such a transmission of the AC input voltage, there disadvantageously occurs a not inconsiderable emission of electric and magnetic fields by the lines from the output of the inverter to the slip ring, which can have a negative influence on the electronic systems in the vicinity. A further disadvantage in such a transmission is that the power that can be transmitted and the length of the permissible transmission line from the inverter to the high voltage generator are limited by the frequency of the AC input voltage. This is because, depending on the frequency, voltage drops or transmission losses occur as a result of the inductances and loss resistances present in the lines.

SUMMARY OF THE INVENTION

The invention addresses the problem of configuring an X-ray device of the kind mentioned in the introduction in such a way that a separation of inverter and high voltage generator is achieved with the minimum possible transmission losses.

This object is achieved according to the invention, for an X-ray device, by a resonance network being formed between the inverter and the high voltage generator.

A resonance network is understood as being a network of various electrical components, which is configured such that it comprises at least one resonant transmission frequency. In a resonant transmission frequency, the lowest power dissipation occurs along the transmission line. Thus, for example, in the case of a resonance network configured as a resonant circuit, the capacitive and inductive reactances are theoretically canceled out where there is a resonant transmission frequency, so that a transmission loss only occurs as a result of ohmic resistances. Thus the transmission losses between the inverter and the high voltage generator can be minimized by means of a resonance network.

Furthermore, when transmitting an AC input voltage generated by the inverter over a resonance network where there is a resonant transmission frequency, the shape of the curve for the output current of the inverter is sinusoidal. This results in the lowest possible proportion of harmonics so that the emission of magnetic fields is consequently minimized.

To form the resonance network, the inductances of the electrical components employed for the transmission of the AC input voltage (wiring, transmission line, leakage inductance of the high voltage generator) are used in particular. The resonance network is then formed, using at least one available or additional capacitor and the inductances being included. Said resonance network transmits the AC input voltage of the inverter at a resonance frequency with low power dissipation and with low emission of electromagnetic fields, so that there is no interference with the electronic components in the vicinity.

In an advantageous embodiment of the invention, the resonance network is a multiresonance network. A multiresonance network is understood therein as being such a resonance network that comprises a plurality of resonant transmission frequencies. This can be achieved by a corresponding configuration with capacitors and/or inductances including the capacitors and inductances of the electrical components used for transmission. A multiresonance network offers the advantage of improving the controllability of the inverse rectifier of the inverter.

With the formation of a resonance network between the inverter and the high voltage generator, the AC input voltage of the inverter can be transmitted to the high voltage generator with low power dissipation being incurred. In particular, the inverter can be spatially decoupled from the high voltage generator, as is particularly desirable in medical applications of the X-ray source. In particular, the high voltage generator and the X-ray source can be disposed on the rotating gantry of a computer tomography scanner, whilst the inverter is set up in a fixed position spatially separated from a computer tomography scanner.

It has proved to be advantageous if an isolating transformer is disposed between the inverter and the high voltage generator for potential isolation. Such an isolating transformer is used for potential isolation of the transmission line from the inverse rectifier to the high voltage generator. Such a potential isolation achieves an attenuation of inverter interference in the direction of the transmission line and guarantees greater electrical safety.

In an advantageous embodiment, the isolating transformer has an output that is balanced to ground. As a result thereof, the voltage rating against the ground potential is reduced to half of the output voltage. Furthermore, the balanced to ground configuration results in voltages on the output lines constantly having an exactly opposite countercurrent potential, as a result of which electric fields at a considerable distance from the transmission line fall off, thus ensuring high electromagnetic compatibility of the X-ray device even with respect to electric fields.

In a further advantageous embodiment, the isolating transformer has grounded potential plates. Such grounded potential plates are located between the coils of the isolating transformer, as a result of which a high frequency screening of the input of the high voltage generator against the output of the inverter is formed. The potential plates additionally keep any electromagnetic interference occurring in the inverter away from the input end of the high voltage generator and the transmission line.

The transformation ratio of the coils in the isolating transformer is ideally selected such that, with a tenable voltage rating on the transmission line, the currents are lowered to reduce the losses in the serial resistors of the transmission line. For this purpose, the voltage is transformed to a correspondingly high level by the isolating transformer. This essentially makes it possible to achieve the desired line lengths even at high operating frequencies whilst incurring low losses.

Advantageously, an ancillary circuit comprising a capacitor is used to form the resonance network, the capacitor of the ancillary circuit being selected in such a way that one or a plurality of desired resonant transmission frequencies are generated with the further inductances of the electrical components used for the transmission. The ancillary circuit can usefully to be disposed such that the at least one capacitor forms a resonant circuit with the further electrical components disposed between the inverter and the high voltage generator. Such a resonant circuit precisely has a resonant transmission frequency with minimal power dissipation. The reactances of capacitors and inductances are theoretically canceled out in this case.

In a development of the X-ray device, the ancillary circuit comprises a plurality of capacitors and likewise optionally one or a plurality of inductances. Through a corresponding circuit engineering arrangement of the capacitors and/or inductances, a resonance network can be formed as desired using the further electrical components in the transmission line, said resonance network displaying in particular the lowest power dissipation at a desired resonant transmission frequency.

It is particularly advantageous if the capacitors and/or inductances of the ancillary circuit are disposed and/or selected in such a way that a resonance frequency of the resonance network is consistent with the inverter output frequency in the operating point for maximum power output. In this event, the whole system has the lowest energy input to generate the high voltage required for the X-ray source.

The transmission of the AC input voltage can be provided in a manner that is known per se using a screened transmission line. The transmission line can be a two-wire line, for example, or can be configured as a cross-wired four-wire line. Coaxial lines can also be used.

As already mentioned, provision can advantageously be made, in the event of the use of the X-ray source for a computer tomography scanner, for the AC input voltage to be supplied to the high voltage generator by means of slip rings. In this arrangement, the AC input voltage can be transmitted by a fixed system to the rotating high voltage generator without problem.

In an alternative embodiment of the X-ray device, the AC input voltage is supplied to the high voltage generator by means of an inductive coupling.

The invention offers in particular the advantage of transmission of an AC input voltage of the inverter to a high voltage generator in a manner that is as loss-free as possible. In particular, the X-ray device offers unproblematic spatial separation of the inverter from the high voltage generator. Because of the low power dissipation, the AC input voltage can also be provided in particular using a screened transmission line, which leads directly into the high voltage generator. Advantageously, however, the X-ray device is suitable for a computer tomography scanner in which the high voltage generator and the X-ray source are disposed on a rotating gantry. By using the resonance network, the AC input voltage of the inverter can be supplied to the high voltage generator in a problem-free manner by means of slip rings and in particular without the harmful emission of electric and/or magnetic fields.

BRIEF DESCRIPTION OF THE DRAWINGS

Embodiments of the invention are explained in more detail by way of a drawing. The drawing shows.

DETAILED DESCRIPTION OF THE INVENTION

Figure 1:
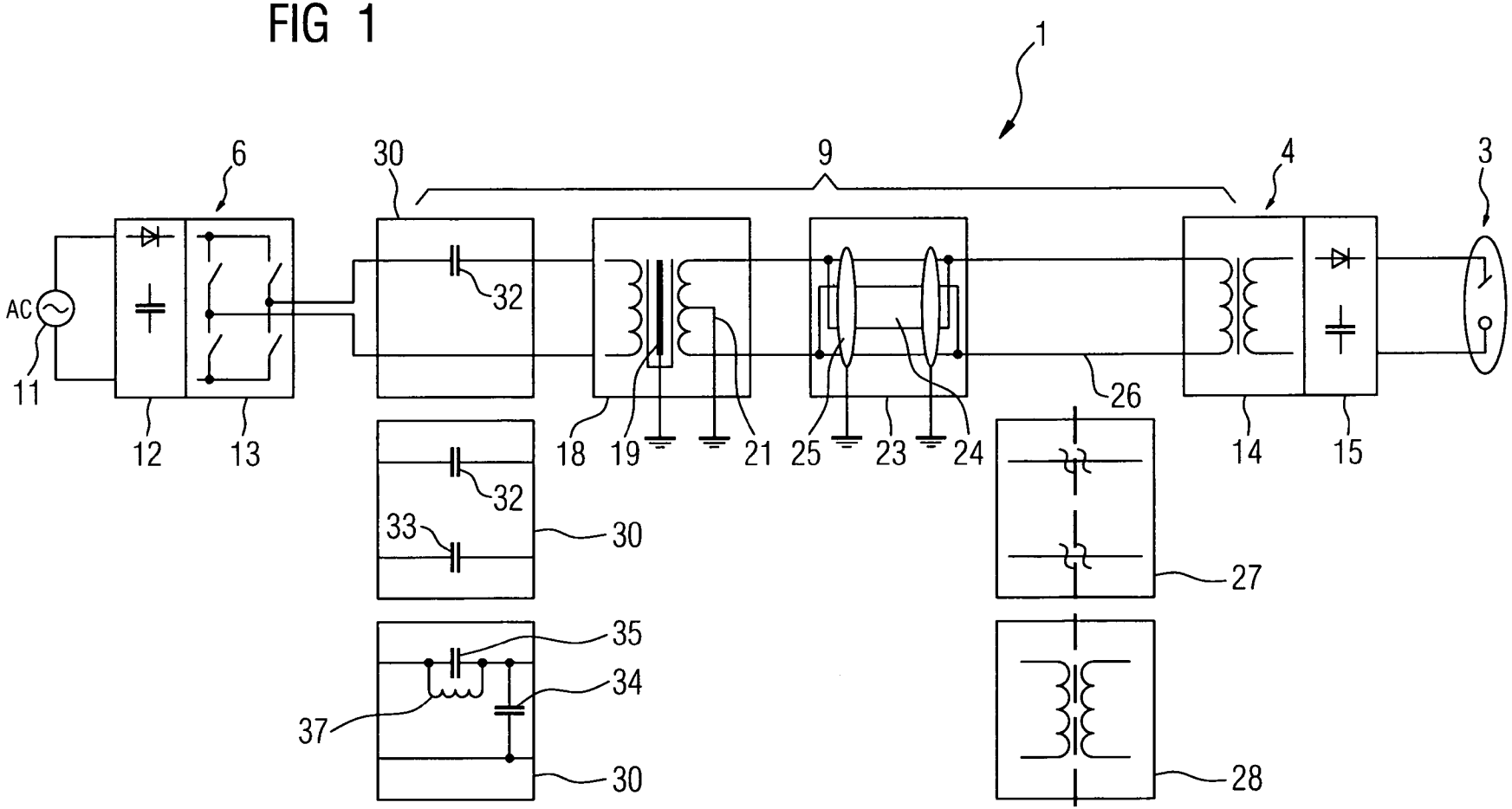
FIG. 1 diagrammatically, in an X-ray device, the energy supply for an X-ray source, wherein a resonance network is formed between an inverter and a high voltage generator and FIG. 2 an equivalent circuit diagram for the X-ray device shown in FIG. 1.

FIG. 1 shows a diagram of an X-ray device 1, comprising an X-ray source 3, said source being supplied with the required high voltage or energy by a high voltage generator 4. To generate the high voltage, the high voltage generator 4 is connected at the input end to the output of an inverter 6, which generates at the output en d the AC input voltage required by the high voltage generator 4. The inverter 6 is connected to a conventional power supply, shown here by the AC voltage source 11.

The transmission line between the inverter 6 and the high voltage generator 4 is altogether configured as a resonance network 9, which has a resonant transmission frequency set with maximum output at the operating point of the inverter 6. When an AC input voltage is transmitted at the resonant transmission frequency of the resonance networks 9, there is low power dissipation and low emission of magnetic fields.

In order to generate the high voltage required by the X-ray source 3, the inverter 6 first comprises a rectifier, shown here symbolically by the diode that has been drawn in, said rectifier generating a DC voltage for an intermediate circuit 12 from the network AC voltage of the AC voltage source 11. The DC voltage is capacitively equalized, shown symbolically by a capacitor. The equalized DC voltage of the intermediate circuit 12 is used in the inverter 6 as input voltage for an inverse rectifier 13, which, at the output end, generates the AC input voltage required by the high voltage generator 4, for example by means of time-actuated semiconductor elements.

The AC input voltage generated by the inverter 6 by means of the inverse rectifier 13 is transmitted by means of the resonance network 9 to a transformer 14 in the high voltage generator 4. The transformer 14 transforms the AC input voltage of the inverter 6 up into an AC voltage which is rectified by means of a rectifier 15, shown by a diode and a capacitor, into the high voltage required by the X-ray source 3, in the order of magnitude of 100 kV.

The resonance network 9, over which the transmission of the AC input voltage takes place from the inverter 6 to the high voltage generator 4, comprises an isolating transformer 18, which transforms upwards the AC input voltage generated by the inverse rectifier 13 in order to reduce the losses. In this arrangement, grounded potential plates 19 are disposed between the coils of the isolating transformer 18. Said potential plates 19 represent a high-frequency screen, as a result of which the emission characteristics of the transmission line as a whole are improved. By means of a grounding 21, a balanced to ground output of the isolating transformer 18 is ensured, so that the voltages on the output lines are always on the exactly opposite potential. Thus electric fields further removed from the transmission line fall off, as a result of which interference to electronic components in the vicinity is minimized and consequently the electromagnetic compatibility is improved.

The transmission between the isolating transformer 18 and the high voltage generator 4 is achieved by means of a transmission line 23 which is configured as a cross-wired four wire circuit 24 having a grounded screen 25. Alternatively, the transmission line 23 can also be formed from coaxial lines comprising one or a plurality of lines.

To form the resonance network 9, the transmission line further comprises an ancillary circuit 30, which, in the simplest scenario, is formed by a capacitor 32 inserted into a transmission line. The capacitor 32 forms a resonant circuit with the inductances of the isolating transformer 18, the transmission line 23, and the leakage inductance of the high voltage generator 4. When tuned to the resonant transmission frequency, the impedance of the resonant circuit has a minimum that is only formed from the sum of the serial resistances. In this way, it is theoretically possible to compensate for the effect of the inductances that can lead to power dissipation. The capacitor 32 is moreover selected in such a way that the resonant transmission frequency of the resonant circuit forming the resonance network 9 is consistent with the operating point for the maximum output of the inverter 6. In this way, overall, transmission of the AC input voltage is effected by the inverter 6 to the high voltage generator 4, said transmission having minimized power dissipation and minimized radiation characteristics. Electronic components in the vicinity are given optimum protection against interference from electromagnetic fields.

Various ancillary circuits 30 can be used for the X-ray device 1 that is shown. In all, three alternatives are shown together. The simplest alternative comprises (as described) a capacitor 32 inserted into an output line. It is also equally possible to configure the capacitors symmetrically, such that, alongside the capacitor 32 that is inserted into an output line, a further capacitor 33 is integrated into the other output line. This has the advantage that the output voltages become symmetrical with the ground potential.

In a further alternative, the resonance network 9 is extended into a multiresonance network by means of the ancillary circuit 30. For this purpose, the ancillary circuit 30 comprises, for example, a capacitor 35 inserted in an output line, said capacitor being bridged by an inductance 37, and likewise a capacitor 34, which is connected between the output lines. In such an embodiment, the resonance network 9 has a plurality of resonant transmission frequencies, so that the controllability of the inverse rectifier is improved.

The transmission line 23 shown in FIG. 1 in the form of a four wire cross-wired line 24, having a screen 25, allows transmission of the AC input voltage of the inverter 6 to the high voltage generator 4 even over relatively large distances, so that spatial separation of the inverter 1 from the high voltage generator 4 and the X-ray source 3 can be achieved. In particular, the end of the transmission line 23 can be directly connected to the high voltage generator 4, as shown, so that it is possible to have a fixed X-ray source 3 that is spatially separated from the inverter 6, as required, for example, for an angiography system.

In the event of an X-ray source 3 being used in a rotating system, such as, for example, in the gantry of a computer tomography scanner, the transmission of the AC input voltage can be equally well achieved by means of slip rings 27, however. Transmission using an inductive coupling 28 is equally possible.

Figure 2:
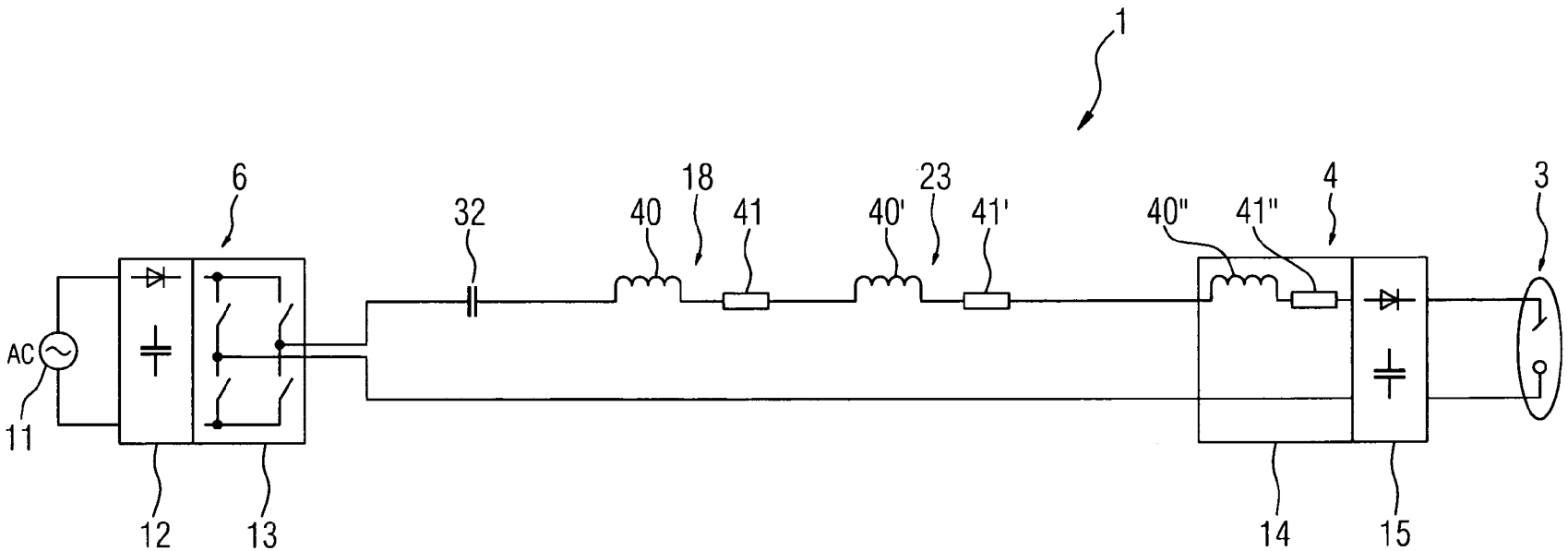

FIG. 2 shows an equivalent circuit diagram for the X-ray device 1 according to FIG. 1, in which the resonance network 9 is formed by means of a capacitor 32 inserted into an output line.

In the equivalent circuit diagram, it is possible to detect the AC voltage source 11 and also the inverter 6, which comprises an intermediate circuit 12 and an inverse rectifier 13. The diagram further shows the high voltage generator 4 with the transformer 14 and the rectifier 15, said generator being connected at the output end to the X-ray source 3.

Since the capacitor 32 forms a resonant circuit together with the inductances of the isolating transformer 18 and the transmission line 23 and the leakage inductance of the high voltage generator, the individual components in the transmission line can be shown in simplified form as inductances and ohmic resistors. Thus the isolating transformer 18 is represented by an inductance 40 and an ohmic resistor 41. The transmission line 23 and the transformer 14 of the high voltage generator 4 are each represented by the inductances 40' and 40" respectively and by the ohmic resistors 41' and 41" respectively.

In the alternative circuit diagram according to FIG. 2, it is immediately possible to identify the resonant circuit formed from the capacitor 32 and the inductances 40, 40' and 40" of the electrical components in the transmission line. At the resonant transmission frequency, the reactances of the capacitor 32 and of the inductances 40, 40' and 40" are equal in size and opposite. Thus power dissipation is caused only by the ohmic resistors 41, 41' and 41". The power dissipation on the transmission line as a whole is minimized. The resonant circuit likewise ensures that the output current of the inverter 6 is sinusoidal, as a result of which the radiation characteristics are reduced. Surface wave phenomena do not occur.

The invention claimed is:

1. An X-ray device used in a medical procedure, comprising an X-ray source;

a high voltage generator connected to the X-ray source that supplies power to the X-ray source;

an inverter that generates an AC input voltage for the high voltage generator; and a resonance network that connects the inverter and the high voltage generator, wherein the resonance network comprises an isolating transformer for potential isolation.

2. The X-ray device as claimed in claim 1, wherein the resonance network is a multiresonanee network.

3. The X-ray device as claimed in claim 1, wherein the isolating transformer comprises a transformation ratio to minimize a transmission loss.

4. The X-ray device as claimed in claim 1, wherein the isolating transformer comprises an output that is balanced to ground.

5. The X-ray device as claimed in claim 4, wherein the isolating transformer comprises a grounded potential plate.

6. The X-ray device as claimed in claim 1, wherein the resonance network comprises a screened transmission line that transmits the AC input voltage.

7. The X-ray device as claimed in claim 1, wherein the AC input voltage is transmitted to the high voltage generator by a slip ring.

8. The X-ray device as claimed in claim 1, wherein the AC input voltage is transmitted to the high voltage generator by an inductance coupling.

9. The X-ray device as claimed in claim 1, wherein the X-ray device is used in a computer tomography scanner.

10. An X-ray device used in a medical procedure, comprising an X-ray source;

a high voltage generator connected to the X-ray source that supplies power to the X-ray source;

an inverter that generates an AC input voltage for the high voltage generator; and a resonance network that connects the inverter and the high voltage generator, wherein the resonance network comprises an ancillary circuit.

11. The X-ray device as claimed in claim 10, wherein the ancillary circuit comprises a capacitor.

12. The X-ray device as claimed in claim 11, wherein the capacitor forms an oscillating circuit.

13. The X-ray device as claimed in claim 12, wherein the oscillating circuit is a resonant circuit.

14. The X-ray device as claimed in claim 11, wherein the capacitor is selected in such a way that a resonance frequency of the resonance network is consistent with an output frequency of the inverter in an operating point for a maximum power output.

15. The X-ray device as claimed in claim 10, wherein the ancillary circuit comprises an inductance.

16. The X-ray device as claimed in claim 15, wherein the inductance is disposed in such a way that a resonance frequency of the resonance network is consistent with an output frequency of the inverter in an operating point for a maximum power output.

17. A method for supplying power to an X-ray source of an X-ray device used in a medical procedure, comprising:

generating an AC input voltage by an inverter;

connecting the inverter to a high voltage generator by a resonance network;

transmitting the AC input voltage to the high voltage generator by the resonance network;

connecting the high voltage generator to the X-ray source; and supplying power generated by the high voltage generator to the X-ray sourcer, wherein the resonance network comprises an isolating transformer for potential isolation or an ancillary circuit.

* * * * *